US008763575B2

(12) United States Patent
Arase et al.

(10) Patent No.: US 8,763,575 B2
(45) Date of Patent: Jul. 1, 2014

(54) VALVE TRAIN MECHANISM OF INTERNAL COMBUSTION ENGINE

(71) Applicants: Suzuki Motor Corporation, Shizuoka-Ken (JP); Kunio Arase, Shizuoka-Ken (JP); Shuichi Yokota, Shizuoka-Ken (JP); Toru Okamura, Shizuoka-Ken (JP); Daisuke Yoshimoto, Shizuoka-Ken (JP)

(72) Inventors: Kunio Arase, Shizuoka-Ken (JP); Shuichi Yokota, Shizuoka-Ken (JP); Toru Okamura, Shizuoka-Ken (JP); Daisuke Yoshimoto, Shizuoka-Ken (JP)

(73) Assignee: Suzuki Motor Corporation, Hamamatsu-shi, Shizuoka-Ken (JP)

( * ) Notice: Subject to any disclaimer, the term of this patent is extended or adjusted under 35 U.S.C. 154(b) by 0 days.

(21) Appl. No.: 13/738,470

(22) Filed: Jan. 10, 2013

(65) Prior Publication Data

US 2013/0180488 A1 Jul. 18, 2013

(30) Foreign Application Priority Data

Jan. 13, 2012 (JP) ..... 2012-005459

(51) Int. Cl.
*F01L 1/14* (2006.01)
*F01L 1/18* (2006.01)
*F01M 11/02* (2006.01)

(52) U.S. Cl.
CPC . *F01L 1/18* (2013.01); *F01M 11/02* (2013.01)
USPC ..... 123/90.39; 123/90.16

(58) Field of Classification Search
CPC ..... F01L 1/18; F01L 1/185; F01M 11/02
USPC ..... 123/90.16, 90.39, 90.6
See application file for complete search history.

(56) References Cited

U.S. PATENT DOCUMENTS 3,628,513 A 12/1971 Grosseau

FOREIGN PATENT DOCUMENTS

| | | | |
|---|---|---|---|
| DE | 7013669 | U | 5/1971 |
| FR | 549594 | A | 2/1923 |
| JP | 59116509 | U | 8/1984 |
| JP | 60-88809 | A | 5/1985 |
| JP | 2011-163135 | A | 8/2011 |

OTHER PUBLICATIONS

Extended European Search Report Application No. 13150867.3 dated May 23, 2013.

*Primary Examiner* — Zelalem Eshete
(74) *Attorney, Agent, or Firm* — Barnes & Thornburg LLP

(57) ABSTRACT

A valve train mechanism of an internal combustion engine including a cylinder head formed with an intake port and an exhaust port, and a camshaft including a valve for opening or closing the intake port and the exhaust port formed in the cylinder head of the engine, a cam mounted to the camshaft so as to be rotated together, and a rocker arm supported on a rocker shaft to be swingable, in which the valve is opened or closed by swinging the rocker arm by rotation of the cam. The rocker shaft is formed with an oil passage, inside the rocker shaft, extending in an axial direction and with an oil outlet communicating with the oil passage and extending in a radial direction of the rocker shaft.

4 Claims, 6 Drawing Sheets

VALVE TRAIN MECHANISM OF INTERNAL COMBUSTION ENGINE

PRIORITY CLAIM

This patent application claims priority to Japanese Patent Application No. 2012-005459, filed 13 Jan. 2012, the disclosure of which is incorporated herein by reference in its entirety.

BACKGROUND OF THE INVENTION

1. Field of the Invention

The present invention relates to a valve train mechanism of an internal combustion engine for opening or closing a valve (an intake valve, an exhaust valve) by swinging a rocker arm by rotation of a cam.

2. Related Art

Conventionally, there is known a structure, to lubricate a sliding contact portion between a rocker arm and a cam, which includes an oil injection hole formed at a bearing of the rocker arm through which lubricating oil in an oil passage in a rocker shaft is injected (see Patent Document 1: Japanese Utility Model Laid-Open Publication No. 59-116509).

However, according to the structure disclosed in the Patent Document 1, since the oil injection hole communicates with the oil passage in the rocker shaft at all times, the pressure of lubricating oil is difficult to control. Particularly, in a low-speed rotation range of an engine, the rotation speed of an oil pump is low, and hence, the lubricating oil pressure becomes low, and when the lubricating oil is continuously injected from the oil injection hole of the rocker arm, the oil pressure may become insufficient, which provides a fear of preventing desirable supply of the lubricating oil to respective components or portions of the engine.

SUMMARY OF THE INVENTION

The present invention was conceived in consideration of the circumstance described above, and an object thereof is to provide a valve train mechanism of an internal combustion engine capable of desirably lubricating a sliding contact portion between a rocker arm and a cam, and also, of securing sufficient pressure on lubricating oil that is supplied to the respective components or portions of the engine.

The above and other objects of the present invention can be achieved by providing a valve train mechanism of an internal combustion engine which includes a cylinder head formed with an intake port and an exhaust port, and a camshaft, the valve train mechanism including: a valve for opening or closing the intake port and the exhaust port formed in the cylinder head of the engine; a cam mounted to the camshaft so as to be rotated together; and a rocker arm supported on a rocker shaft to be swingable, wherein the valve is opened or closed by swinging the rocker arm by rotation of the cam, the rocker shaft is formed with an oil passage, inside the rocker shaft, extending in an axial direction and with an oil outlet communicating with the oil passage and extending in a radial direction of the rocker shaft, the rocker arm includes a bearing portion supported on the rocker shaft, the bearing portion being formed with an oil injection hole for injecting lubricating oil from the oil outlet to a sliding contact portion side between the rocker arm and the cam, and the oil injection hole and the oil outlet are constructed at least so as not to be overlapped with each other at a time when the rocker arm is in sliding contact with a base circle portion of the cam and so as to be overlapped with each other at a time when the rocker arm is in sliding contact with a nose portion of the cam in a predetermined press-down state.

According to the present invention of the character and structure mentioned above, the oil injection hole of the rocker arm and the oil outlet of the rocker shaft are formed so as to be overlapped with each other at a time when the rocker arm is in sliding contact with the nose portion of the cam and in a predetermined press-down state. Thus, the lubricating oil can be injected from the oil injection hole to the sliding contact portion between the rocker arm and the cam, and the sliding contact portion can be desirably lubricated.

Furthermore, the oil injection hole of the rocker arm and the oil outlet of the rocker shaft are formed so as not to be overlapped with each other at a time when the rocker arm is in sliding contact with the base circle portion of the cam and the rocker arm is not pressed downward. Thus the flow-out of the lubricating oil from the oil injection hole is restricted, and the pressure on the lubricating oil that is supplied to the respective components or parts of the engine can be sufficiently secured during such operation period.

BRIEF DESCRIPTION OF THE DRAWINGS

In the accompanying drawings:

FIGS. 4A and 4B show a relationship between a rocker shaft in FIG. 1 and a pin, in which FIG. 4A is a perspective view showing a state before engagement of the pin, and FIG. 4B is a perspective view showing an engaged state of the pin;

DESCRIPTION OF THE PREFERRED EMBODIMENT

Hereunder, an embodiment for carrying out the present invention will be described with reference to the accompanying drawings. It is further to be noted that terms "upper", "lower", "right", "left" and the like terms indicating direction are used herein with reference to the illustrations of the drawings in basic concept.

Figure 1:
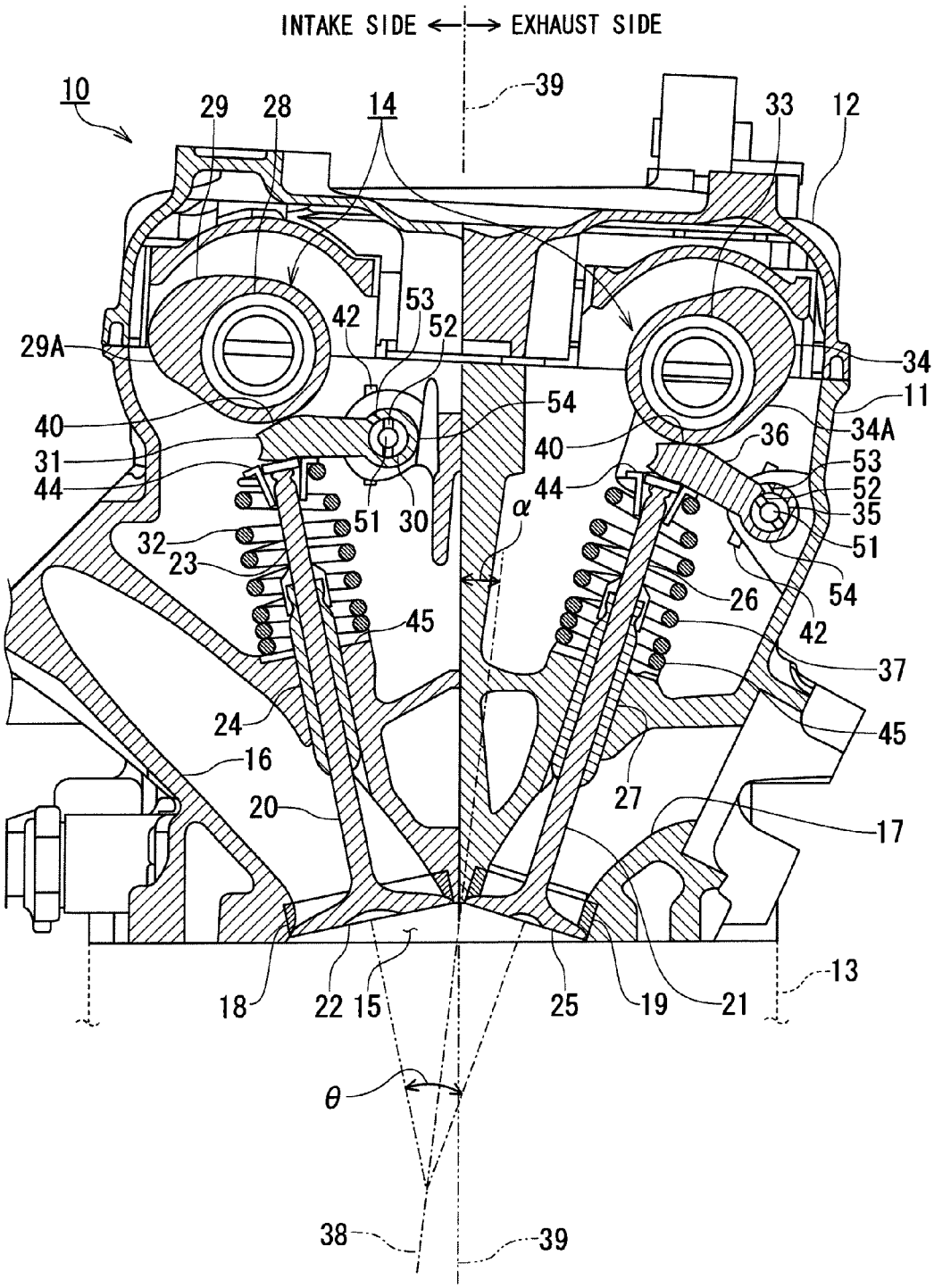
FIG. 1 is a sectional view of a valve train mechanism of an internal combustion engine according to an embodiment of the present invention.

With reference to FIG. 1 showing sectional view of a valve train mechanism of an engine according to an embodiment of the present invention, an engine 10 is an engine mounted on a motorcycle, for example, and a valve train mechanism, a DOHC valve train mechanism 14 in the present embodiment, is provided inside a cylinder head 11 and head cover 12 of the engine 10.

That is, as shown in FIG. 1, the cylinder head 11 of the engine 10 is provided with a combustion chamber 15 formed between the cylinder head 11 and a cylinder block 13, an intake port 16 communicating with the combustion chamber 15, and an exhaust port 17 communicating with the combustion chamber 15. The intake port 16 and the exhaust port 17 include valve seats 18 and 19, respectively, at the connection portions to the combustion chamber 15. The valve train mechanism 14 opens or closes, respectively, each of an intake valve 20 provided to the intake port 16 and two exhaust valves 21 provided to the exhaust port 17.

The intake valve 20 opens or closes the intake port 16. The intake valve 20 includes an umbrella-shaped disc 22, and a valve stem 23 extending substantially upward from the center of the disc 22. Further, the cylinder head 11 includes a stem guide 24 into which the valve stem 23 is slidably inserted.

On the other hand, the exhaust valve 21 opens or closes the exhaust port 17. The exhaust valve 21 includes an umbrella-shaped disc 25, and a valve stem 26 extending substantially upward from the center of the disc 25. Further, the cylinder head 11 includes a stem guide 27 into which the valve stem 26 is slidably inserted.

The valve train mechanism 14 includes the intake valve 20, an intake camshaft 28 rotatably supported on the cylinder head 11, an intake cam 29 provided to the intake camshaft 28 so as to be rotated together, an intake rocker shaft 30 fixedly supported on the cylinder head 11, an intake rocker arm 31 swingably supported on the intake rocker shaft 30, and an intake valve spring 32 for biasing (urging) the intake valve 20 in the closing direction, and the valve train mechanism 14 opens or closes the intake valve 20 by causing, by rotation of the intake cam 29, the intake rocker arm 31 to swing around the intake rocker shaft 30 according to the cam profile of the intake cam 29.

Furthermore, the valve train mechanism 14 includes the exhaust valve 21, an exhaust camshaft 33 rotatably supported on the cylinder head 11, an exhaust cam 34 provided to the exhaust camshaft 33 so as to be rotated together, an exhaust rocker shaft 35 fixedly supported on the cylinder head 11, an exhaust rocker arm 36 swingably supported on the exhaust rocker shaft 35, and an exhaust valve spring 37 for biasing (urging) the exhaust valve 21 in the closing direction, and the valve train mechanism 14 opens or closes the exhaust valve 21 by causing, by rotation of the exhaust cam 34, the exhaust rocker arm 36 to swing around the exhaust rocker shaft 35 according to the cam profile of the exhaust cam 34.

The intake valve 20 and the exhaust valve 21 are arranged in an inverted V-shape as viewed from the axial directions of the intake camshaft 28 and the exhaust camshaft 33. Furthermore, a valve angle centerline 38 that bisects a valve angle $\theta$ between the intake valve 20 and the exhaust valve 21 is set being biased, by an angle $\alpha$, toward the exhaust side (the exhaust camshaft 33 side) than a cylinder axial line 39 of the cylinder head 11 as viewed from the axial line directions of the intake camshaft 28 and the exhaust camshaft 33.

The intake camshaft 28 is positioned above the intake valve 20 and is rotatably supported by the cylinder head 11 and the head cover 12. The shaft center of the intake camshaft 28 is arranged on a substantially extended line of the valve stem 23 of the intake valve 20.

Further, the exhaust camshaft 33 is positioned above the exhaust valve 21 and is rotatably supported by the cylinder head 11 and the head cover 12. The shaft center of the exhaust camshaft 33 is arranged on a substantially extended line of the valve stem 26 of the exhaust valve 21. The intake camshaft 28 and the exhaust camshaft 33 are arranged such that the shaft centers are substantially parallel to each other.

As viewed from the axial direction of the intake camshaft 28, the intake rocker shaft 30 is positioned on the upstream side in a rotational direction P (FIGS. 2 and 3) of the intake cam 29 with respect to a sliding contact portion 40 between the intake rocker arm 31 and the intake cam 29. Furthermore, as shown in FIG. 1, as viewed from the axial direction of the intake camshaft 28, the intake rocker shaft 30 is positioned nearer to the cylinder axial line 39 than the intake camshaft 28.

On the other hand, as viewed from the axial direction of the exhaust camshaft 33, the exhaust rocker shaft 35 is positioned on the upstream side in a rotational direction P (FIGS. 2 and 3) of the exhaust cam 34 with respect to a sliding contact portion 40 of the exhaust rocker arm 36 and the exhaust cam 34. Furthermore, as shown in FIG. 1, as viewed from the axial direction of the exhaust camshaft 33, the exhaust rocker shaft 35 is positioned farther apart from the cylinder axial line 39 than the exhaust camshaft 33.

Figure 4A:
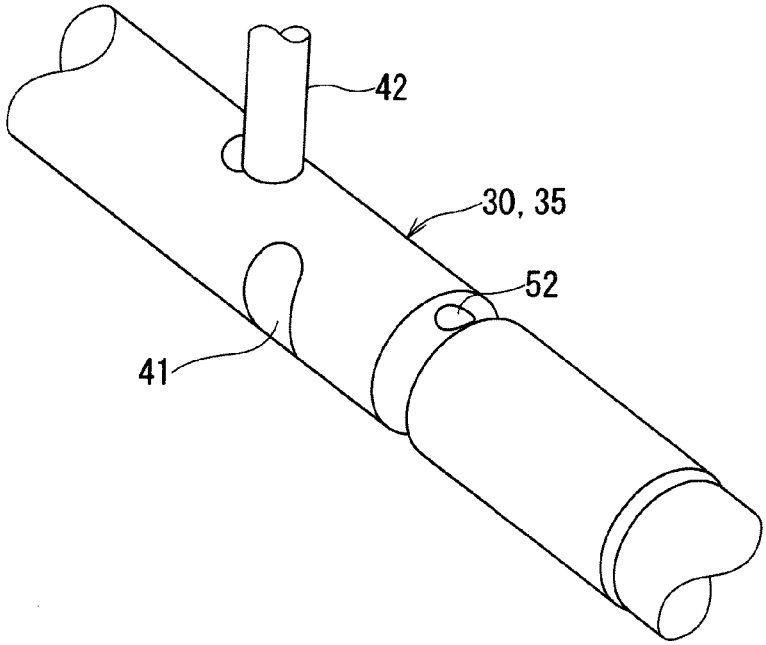
Figure 4B:
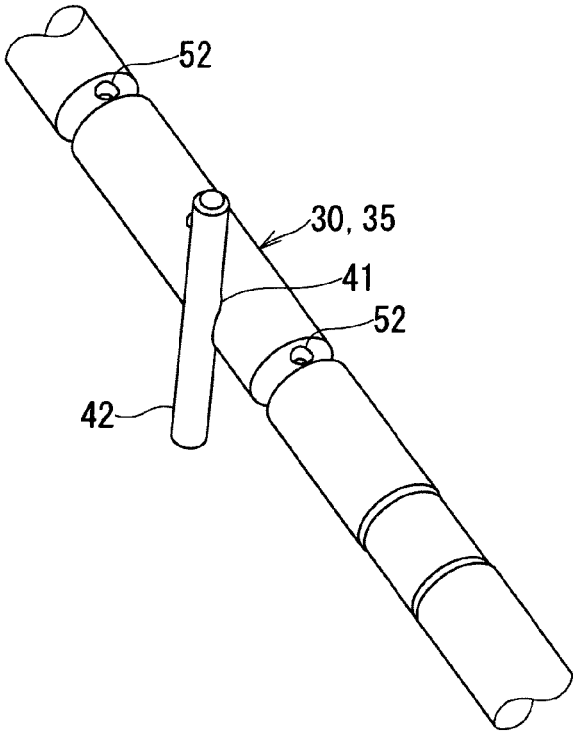

Moreover, as shown in FIG. 4A, a cutout groove 41 is formed on the side surface of each of the intake rocker shaft 30 and the exhaust rocker shaft 35, and also, as shown in FIG. 1, a pin 42 is inserted into the cylinder head 11, and as shown in FIG. 4B, at a time when the pin 42 is engaged with the cutout groove 41, the rotation of the intake rocker shaft 30 due to the swinging motion of the intake rocker arm 31 or the rotation of the exhaust rocker shaft 35 due to the swinging motion of the exhaust rocker arm 36 is prevented, and the intake rocker shaft 30 or the exhaust rocker shaft 35 is held in a state of being fixed to the cylinder head 11.

Figure 2:
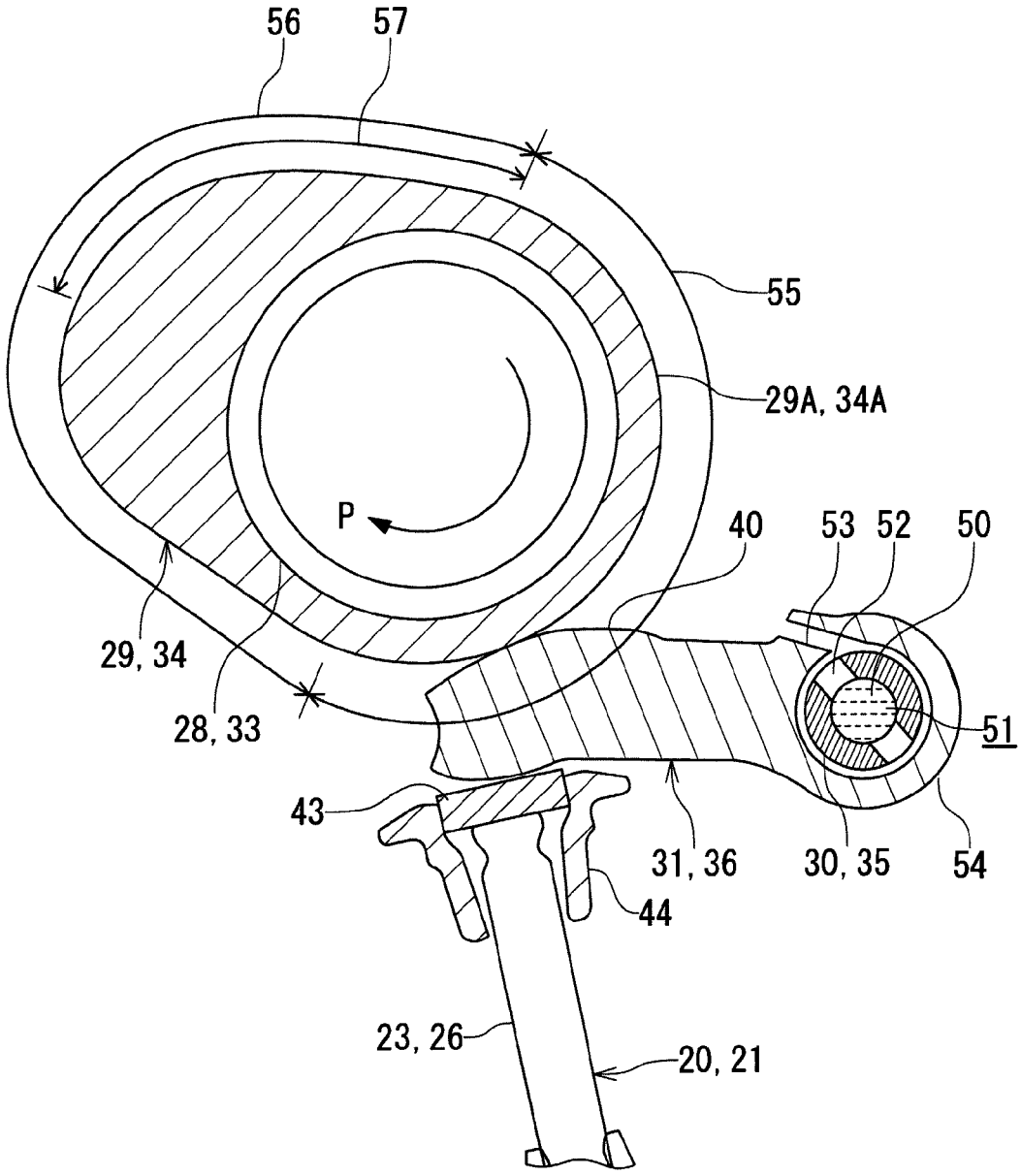
FIG. 2 is an operational view showing a positional relationship between a cam, a rocker arm and a valve in a state where the rocker arm is not pressed down by the cam in FIG. 1.
Figure 3:
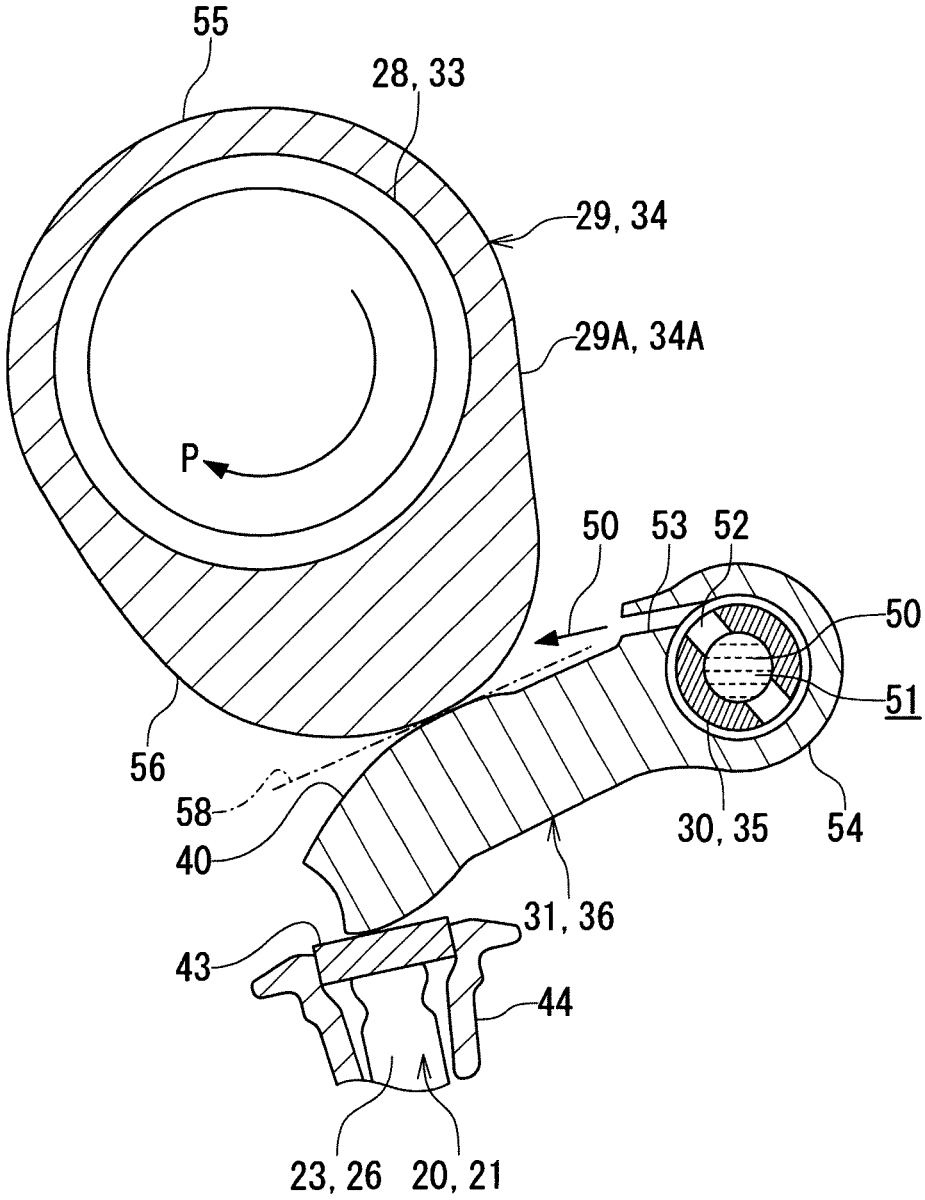
FIG. 3 is an operational view showing a positional relationship between the cam, the rocker arm and the valve in a state where the rocker arm is maximally pressed down by the cam in FIG. 1.

As shown in FIGS. 1 to 3, the intake rocker arm 31 is a cantilever rocker arm that is interposed or sandwiched, via a shim 43, between a cam surface 29A of the intake cam 29 and an upper end portion of the valve stem 23 of the intake valve 20. The exhaust rocker arm 36 is also a cantilever rocker arm that is interposed, via a shim 43, between a cam surface 34A of the exhaust cam 34 and an upper end portion of the valve stem 26 of the exhaust valve 21.

As described, the intake rocker arm 31 and the exhaust rocker arm 36 are so-called finger follower rocker arms, which swing in a trailing manner by arranging the intake rocker shaft 30 on the upstream side in the rotational direction P of the intake cam 29 than the sliding contact portion 40 between the intake rocker arm 31 and the intake cam 29, and also by arranging the exhaust rocker shaft 35 on the upstream side in the rotational direction P of the exhaust cam 34 than the sliding contact portion 40 between the exhaust rocker arm 36 and the exhaust cam 34.

A tensile load toward the front end side is thereby applied to the intake rocker arm 31 or the exhaust rocker arm 36 by the rotation of the intake cam 29 or the exhaust cam 34, causing the motion of moving away from the intake rocker shaft 30 or the exhaust rocker shaft 35, and thus, a load acting on the intake rocker shaft 30 or the exhaust rocker shaft 35 is reduced.

Furthermore, as shown in FIG. 1, the intake valve spring 32 is interposed between a retainer 44 provided at the upper end portion of the valve stem 23 of the intake valve 20 and a seating surface 45 of the cylinder head 11, and the intake valve spring 32 biases (i.e., urges) the intake valve 20 in the closing direction via the retainer 44. The disc 22 of the intake valve 20 is pressed against the valve seat 18 by the biasing force of the intake valve spring 32 and closes the intake port 16.

On the other hand, the exhaust valve spring 37 is interposed between a retainer 44 provided at the upper end portion of the valve stem 26 of the exhaust valve 21 and a seating surface 45 of the cylinder head 11, and the exhaust valve spring 37 biases the exhaust valve 21 in the closing direction via the retainer 44. The disc 25 of the exhaust valve 21 is pressed against the valve seat 19 by the biasing force of the exhaust valve spring 37 and closes the exhaust port 17.

As described above, the valve train mechanism 14 opens or closes the intake valve 20 by using the intake cam 29 and the intake rocker arm 31 provided correspondingly to the intake valve 20 and by swinging the intake rocker arm 31 by the rotation of the intake cam 29.

On the other hand, the valve train mechanism 14 opens or closes the exhaust valve 21 by using the exhaust cam 34 and the exhaust rocker arm 36 provided correspondingly to the exhaust valve 21 and by swinging the exhaust rocker arm 36 by the rotation of the exhaust cam 34.

According to the valve train mechanism 14 of the structures mentioned above, the sliding contact portion 40 between the intake rocker arm 31 and the intake cam 29, and the sliding contact portion 40 between the exhaust rocker arm 36 and the exhaust cam 34 are lubricated by lubricating oil 50 (FIG. 3). In order to perform such lubrication, an oil passage 51 and an oil outlet 52 are formed in the intake rocker shaft 30 and the exhaust rocker shaft 35, and an oil injection hole 53 is formed in the intake rocker arm 31 and the exhaust rocker arm 36.

Figure 5:
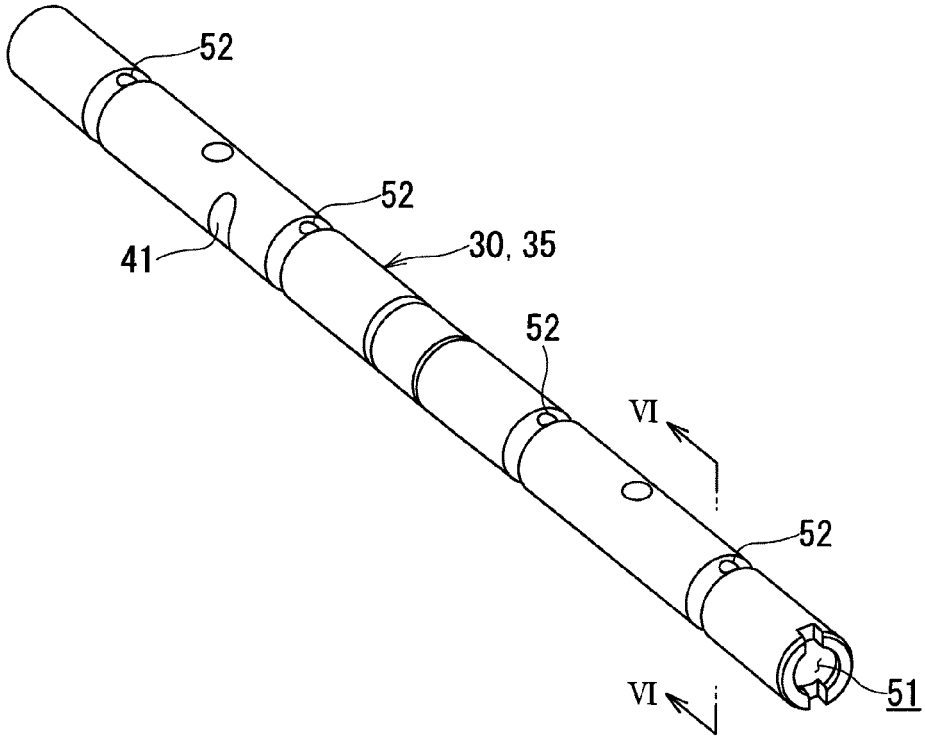
FIG. 5 is a perspective view showing the rocker shaft in FIG. 1.
Figure 6:
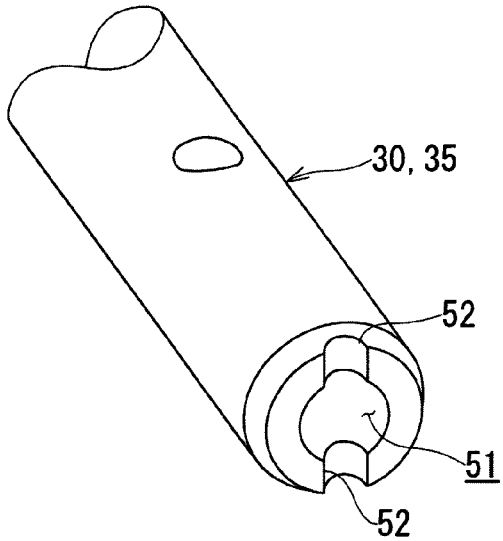
FIG. 6 is a partial perspective view of the rocker shaft showing a cut surface of the rocker shaft cut along the line VI-VI in FIG. 5.

That is, as shown in FIGS. 2, 5 and 6, the intake rocker shaft 30 and the exhaust rocker shaft 35 are each formed to have a hollow shape, and include inside thereof the oil passage 51 extending in the axial direction. That is, the inside spaces of the intake rocker shaft 30 and the exhaust rocker shaft 35 are formed as the oil passages 51, and the lubricating oil 50 is supplied to the oil passages 51.

In addition, the intake rocker shaft 30 is formed with the oil outlet 52 at the installation position of the intake rocker arm 31 so as to extend and pass through the rocker shaft 30 in the radial direction of the intake rocker shaft 30 to communicate with the oil passage 51. On the other hand, the exhaust rocker shaft 35 is also formed with the oil outlet 52 is provided to the exhaust rocker shaft 35 at the installation position of the exhaust rocker arm 36 so as to extend and pass through the exhaust rocker shaft 35 in the radial direction of the exhaust rocker shaft 35 to communicate with the oil passage 51.

Figure 7:
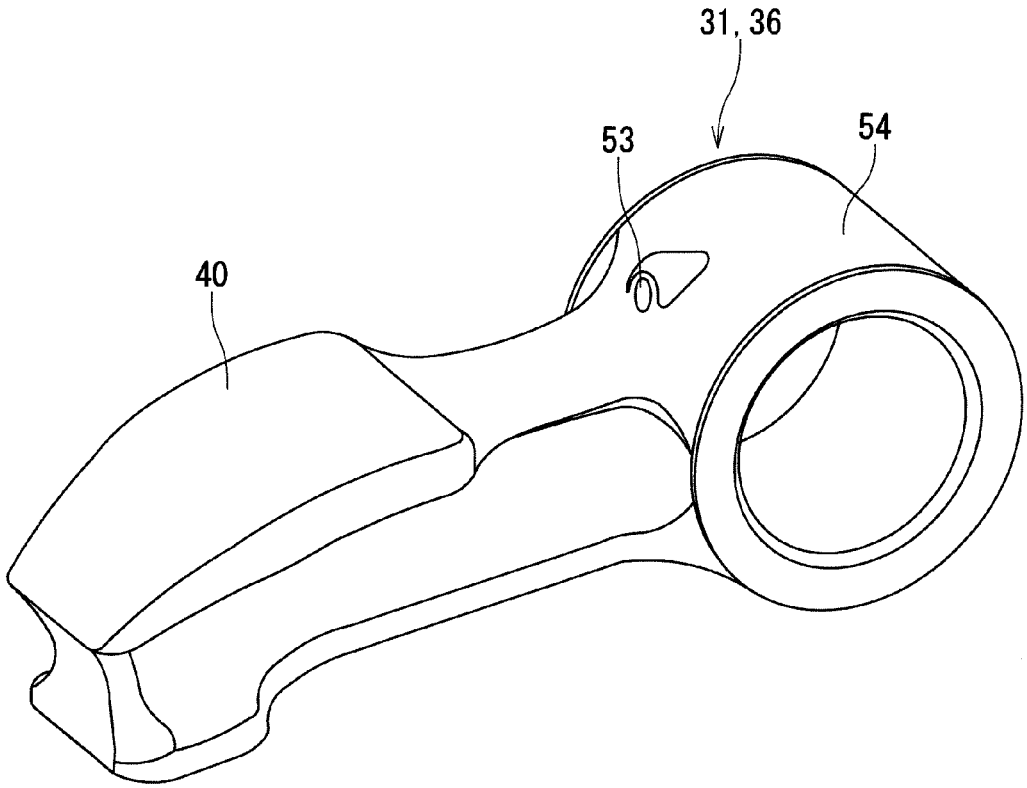
FIG. 7 is a perspective view showing the rocker arm in FIG. 1.

As shown in FIGS. 2, 3 and 7, the intake rocker arm 31 is provided with a bearing portion 54 supported on the intake rocker shaft 30, and the bearing portion 54 is formed with the oil injection hole 53 capable of injecting the lubricating oil 50 from the oil outlet 52 of the intake rocker shaft 30 to the sliding contact portion 40 between the intake rocker arm 31 and the intake cam 29.

The oil injection hole 53 of the intake rocker arm 31 is formed substantially along the longitudinal direction of the intake rocker arm 31 and is directed so as to inject the lubricating oil 50 to the cam surface 29A on the upstream side in the rotational direction P of the intake cam 29 with respect to the sliding contact portion 40 between the intake rocker arm 31 and the intake cam 29.

The exhaust rocker arm 36 is provided with a bearing portion 54 supported on the exhaust rocker shaft 35, and the bearing portion 54 is formed with the oil injection hole 53 capable of injecting the lubricating oil 50 from the oil outlet 52 of the exhaust rocker shaft 35 to the sliding contact portion 40 side between the exhaust rocker arm 36 and the exhaust cam 34.

The oil injection hole 53 of the exhaust rocker arm 36 is formed substantially along the longitudinal direction of the exhaust rocker arm 36 and is directed so as to inject the lubricating oil 50 to the cam surface 34A on the upstream side in the rotational direction P of the exhaust cam 34 with respect to the sliding contact portion 40 between the exhaust rocker arm 36 and the exhaust cam 34.

The oil injection hole 53 of the intake rocker arm 31 and the oil outlet 52 of the intake rocker shaft 30 are provided at least so as not to be overlapped with each other at a time when the intake rocker arm 31 is in sliding contact with a base circle portion 55 of the intake cam 29 and is not pressed downward (i.e., in a state shown in FIG. 2) and so as to be overlapped with each other at a time when the intake rocker arm 31 is in sliding contact with a nose portion 56 of the intake cam 29 and is in a predetermined press-down state (i.e., in a state shown in FIG. 3).

At the time when the oil injection hole 53 and the oil outlet 52 are overlapped with each other, the lubricating oil 50 inside the oil passage 51 is injected from the oil injection hole 53 via the oil outlet 52.

In the present embodiment of the structure mentioned above, the oil injection hole 53 of the intake rocker arm 31 and the oil outlet 52 of the intake rocker shaft 30 are preferably constructed such that the mutually overlapping area becomes the largest at the time when the intake rocker arm 31 is pressed downward maximally by the nose portion 56 of the intake cam 29 and the amount of injection of the lubricating oil 50 from the oil injection hole 53 becomes also maximum.

Furthermore, the oil injection hole 53 of the exhaust rocker arm 36 and the oil outlet 52 of the exhaust rocker shaft 35 are constructed at least so as not to be overlapped with each other at a time when the exhaust rocker arm 36 is in sliding contact with a base circle portion 55 of the exhaust cam 34 and is not pressed downward (i.e., in the state shown in FIG. 2), and so at to be overlapped with each other at a time when the exhaust rocker arm 36 is in sliding contact with a nose portion 56 of the exhaust cam 34 and is in a predetermined press-down state (i.e., in the state shown in FIG. 3).

At the time when the oil injection hole 53 and the oil outlet 52 are overlapped with each other, the lubricating oil 50 inside the oil passage 51 is injected from the oil injection hole 53 via the oil outlet 52.

In the present embodiment of the structure mentioned above, the oil injection hole 53 of the exhaust rocker arm 36 and the oil outlet 52 of the exhaust rocker shaft 35 are preferably constructed so that the mutually overlapped area becomes the largest at a time when the exhaust rocker arm 36 is pressed downward maximally by the nose portion 56 of the exhaust cam 34 and the amount of injection of the lubricating oil 50 from the oil injection hole 53 becomes also maximum.

According to the structure of the present embodiment described above, the following effects (1) to (8) will be attainable.

(1) In the present embodiment, the oil injection hole 53 of the intake rocker arm 31 and the oil outlet 52 of the intake rocker shaft 30 are constructed so as to be overlapped with each other at the time when the intake rocker arm 31 is in sliding contact with the nose portion 56 of the intake cam 29 and is in a predetermined press-down state. The oil injection hole 53 of the exhaust rocker arm 36 and the oil outlet 52 of the exhaust rocker shaft 35 are constructed so as to be overlapped with each other at the time when the exhaust rocker arm 36 is in sliding contact with the nose portion 56 of the exhaust cam 34 and is in a predetermined press-down state. Thus, the lubricating oil 50 can be injected from the oil injection hole 53 toward the sliding contact portion 40 side between the intake rocker arm 31 and the intake cam 29 and toward the sliding contact portion 40 side between the exhaust rocker arm 36 and the exhaust cam 34, and the sliding contact portions 40 can thus be desirably lubricated.

Particularly, the oil injection hole 53 of the intake rocker arm 31 and the oil outlet 52 of the intake rocker shaft 30 are constructed so that the overlapped area is the largest when the intake rocker arm 31 is most pressed downward by the nose portion 56 of the intake cam 29, and the oil injection hole 53 of the exhaust rocker arm 36 and the oil outlet 52 of the exhaust rocker shaft 35 are constructed so that the overlapping area is the largest when the exhaust rocker arm 36 is most pressed downward by the nose portion 56 of the exhaust cam 34. Accordingly, the lubricating oil 50 can be supplied with an effectively increased amount to the sliding contact portion 40 between the intake rocker arm 31 and the intake cam 29 and the sliding contact portion 40 between the exhaust rocker arm 36 and the exhaust cam 34 at the time of desiring the most amount of the lubrication for the sliding contact portions 40.

(2) According to the present embodiment, the oil injection hole 53 of the intake rocker arm 31 and the oil outlet 52 of the intake rocker shaft 30 are constructed so as not to be overlapped with each other when the intake rocker arm 31 is in sliding contact with the base circle portion 55 of the intake cam 29 and is not pressed downward, and the oil injection hole 53 of the exhaust rocker arm 36 and the oil outlet 52 of the exhaust rocker shaft 35 are constructed so as not to be overlapped with each other when the exhaust rocker arm 36 is in sliding contact with the base circle 55 of the exhaust cam 34 and is not pressed downward, thereby effectively restricting the flowing out of the lubricating oil 50 from the oil injection hole 53, and the pressure on the lubricating oil 50 that is supplied to each portion of the engine 10 can be sufficiently secured during the operation.

Particularly, it is possible to prevent the pressure on the lubricating oil 50 from lowering in a low-speed rotation range of the engine 10 at which the rotation speed of an oil pump, not shown, which is driven by the rotation of a crankshaft, not shown, is low, and thus, each component or parts of the engine 10 can be desirably lubricated in the low-speed rotation range of the engine 10.

(3) According to the present embodiment, the oil injection hole 53 of the intake rocker arm 31 is directed so as to inject the lubricating oil 50 on the cam surface 29A on the upstream side in the rotational direction P of the intake cam 29 with respect to the sliding contact portion 40 between the intake rocker arm 31 and the intake cam 29, and the oil injection hole 53 of the exhaust rocker arm 36 is directed so as to inject the lubricating oil 50 on the cam surface 34A on the upstream side in the rotational direction P of the exhaust cam 34 with respect to the sliding contact portion 40 between the exhaust rocker arm 36 and the exhaust cam 34.

Accordingly, the lubricating oil 50 adhering to the cam surface 29A or 34A at a lifting side portion (a pressing down portion) 57 of the nose 56 of the intake cam 29 or the exhaust cam 34 is taken into the sliding contact portion 40 by the rotation of the intake cam 29 or the exhaust cam 34 and a lubricant film can be easily formed on the sliding contact portion 40, and thus, the lubrication of the sliding contact portion 40 can be improved.

(4) According to the present embodiment, since the oil injection hole 53 of the intake rocker arm 31 is formed substantially along the longitudinal direction of the arm of the intake rocker arm 31, the lubricating oil 50 can be accurately injected from the oil injection hole 53 of the intake rocker arm 31 toward the cam surface 29A at the lifting side portion 57 at the nose portion 56 of the intake cam 29 in a state just before the maximum valve lift, i.e., the time when the intake rocker arm 31 is pressed downward maximally by the intake cam 29.

Furthermore, since the oil injection hole 53 of the exhaust rocker arm 36 is formed substantially along the longitudinal direction of the arm of the exhaust rocker arm 36, the lubricating oil 50 can be accurately injected from the oil injection hole 53 of the exhaust rocker arm 36 toward the cam surface 34A at the lifting side portion 57 of the nose portion 56 of the exhaust cam 34 in a state just before the maximum valve lift, i.e., at the time when the exhaust rocker arm 36 is pressed downward maximally by the exhaust cam 34. As a result, a lubricant film can be reliably formed on the cam surface 29A or 34A in the maximum valve lift state.

Similarly, since the oil injection hole 53 of the intake rocker arm 31 is formed substantially along the longitudinal direction of the arm of the intake rocker arm 31, the lubricating oil 50 can be injected from the oil injection hole 53 of the intake rocker arm 31 substantially along a tangential direction 58 of the sliding contact portion 40 between the intake cam 29 and the intake rocker arm 31 in the maximum valve lift state of the intake cam 29.

Furthermore, since the oil injection hole 53 of the exhaust rocker arm 36 is formed substantially along the longitudinal direction of the arm of the exhaust rocker arm 36, the lubricating oil 50 can be injected from the oil injection hole 53 of the exhaust rocker arm 36 substantially along a tangential direction 58 of the sliding contact portion 40 between the exhaust cam 34 and the exhaust rocker arm 36 in the maximum valve lift state of the exhaust cam 34. As a result, the lubrication of the sliding contact portion 40 can be improved when a large load is acting on the sliding contact portion 40.

(5) According to the present embodiment, the intake rocker shaft 30 is arranged, as viewed from the axial direction of the intake camshaft 28, on the upstream side in the rotational direction P of the intake cam 29 with respect to the sliding contact portion 40 between the intake rocker arm 31 and the intake cam 29. Therefore, the oil injection hole 53 formed in the bearing portion 54 of the intake rocker arm 31 can be easily directed toward the cam surface 29A on the upstream side in the rotational direction P of the intake cam 29 with respect to the sliding contact portion 40 between the intake rocker arm 31 and the intake cam 29.

Similarly, the exhaust rocker shaft 35 is arranged, as viewed from the axial direction of the exhaust camshaft 33, on the upstream side in the rotational direction P of the exhaust cam 34 with respect to the sliding contact portion 40 between the exhaust rocker arm 36 and the exhaust cam 34. Therefore, the oil injection hole 53 formed in the bearing portion 54 of the exhaust rocker arm 36 can be easily directed toward the cam surface 34A on the upstream side in the rotational direction P of the exhaust cam 34 with respect to the sliding contact portion 40 between the exhaust rocker arm 36 and the exhaust cam 34.

(6) According to the present embodiment, the intake rocker arm 31 is configured as a cantilever rocker arm that is sandwiched between the cam surface 29A of the intake cam 29 and the upper end portion of the valve stem 23 of the intake valve 20, and the exhaust rocker arm 36 is also configured as a cantilever rocker arm that is sandwiched between the cam surface 34A of the exhaust cam 34 and the upper end portion of the valve stem 26 of the exhaust valve 21, and both the intake and exhaust rocker arms 31 and 36 are constructed as so-called finger follower rocker arms.

Accordingly, the intake rocker arm 31 and the exhaust rocker arm 36 can be made to swing in a trailing manner in accordance with the rotation of the intake cam 29 and the rotation of the exhaust cam 34, respectively. Thus, the tensile load toward the front end side of the intake rocker arm 31 and the tensile load toward the front end side of the exhaust rocker arm 36 are applied to the intake rocker arm 31 and the exhaust rocker arm 36, respectively, and application of load to the intake rocker shaft 30 and to the exhaust rocker shaft 35 can be reduced.

Herein, if the intake rocker arm 31 and the exhaust rocker arm 36 are not of the trailing type, but of a leading type, the nose portion 56 of the intake cam 29 applies, by the rotation of the intake cam 29, a compressive load on the intake rocker arm 31 in the direction of pushing the intake rocker arm 31 into the bearing portion 54 from the front end side, and the nose portion 56 of the exhaust cam 34 applies, by the rotation of the exhaust cam 34, a compressive load on the exhaust rocker arm 36 in the direction of pushing the exhaust rocker arm 36 into the bearing portion 54 from the front end side. Thus, the bending loads acting on the intake rocker shaft 30 and the exhaust rocker shaft 35 are increased.

In contrast, according to the present embodiment, the intake rocker arm 31 and the exhaust rocker arm 36 swing in the trailing manner as described above, and thus, the loads acting on the intake rocker shaft 30 and the exhaust rocker shaft 35 can be reduced and the bending moments acting on the intake rocker shaft 30 and the exhaust rocker shaft 35 can be reduced.

(7) According to the present embodiment, the valve angle centerline 38 between the intake valve 20 and the exhaust valve 21 is set being biased, as viewed from the axial directions of the intake camshaft 28 and the exhaust camshaft 33, toward the exhaust side (the exhaust camshaft 33 side) than the cylinder axial line 39 of the cylinder head 11. Accordingly, the valve portions on the exhaust side (particularly, the exhaust rocker shaft 35, the exhaust rocker arm 36 and the exhaust valve spring 37) can be positioned to be lower than the valve portions on the intake side (particularly, the intake rocker shaft 30, the intake rocker arm 31 and the intake valve spring 32).

As a result, the lubricating oil 50 after lubricating the sliding contact portion 40 between the exhaust rocker arm 36 and the exhaust cam 34 can be scraped off by the rotation of the exhaust cam 34, and can be then supplied to a portion in the vicinity of the upper end portion of the valve stem 26 of the exhaust valve 21. Further, although the temperature of the exhaust valve 21 rises due to exposure to the exhaust gas, by supplying the lubricating oil 50 to the upper end portion of the valve stem 26 of the exhaust valve 21, the exhaust valve 21 can be effectively cooled.

(8) According to the present embodiment, since the intake rocker shaft 30 is arranged nearer to the cylinder axial line 39 of the cylinder head 11 than the intake camshaft 28, as viewed from the axial direction of the intake camshaft 28, the intake port 16 in the cylinder head 11 can be easily formed into a linear shape. As a result, the filling efficiency of the intake by the intake port 16 can be improved.

It is further to be noted that the present invention is not limited to the described embodiment and many other changes and modifications or alternations may be made without departing from the spirits and scopes of the appended claims.

For example, in the present embodiment, the overlapped area of the oil injection hole 53 of the intake rocker arm 31 and the oil outlet 52 of the intake rocker shaft 30 is set to become the largest at the time when the intake rocker arm 31 is mostly pressed downward by the intake cam 29, and the overlapped area of the oil injection hole 53 of the exhaust rocker arm 36 and the oil outlet 52 of the exhaust rocker shaft 35 is set to become the largest at the time when the exhaust rocker arm 36 is mostly pressed downward by the exhaust cam 34. However, the timing at which the overlapped area of the oil injection hole 53 and the oil outlet 52 becomes the largest may be arbitrarily changed by changing the forming position of the oil outlet 52 in the intake rocker shaft 30 or the exhaust rocker shaft 35. The amount of supply of the lubricating oil 50 can thereby be effectively adjusted in accordance with the necessity of lubrication.

What is claimed is:

1. A valve train mechanism of an internal combustion engine which includes a cylinder head formed with an intake port and an exhaust port, and a camshaft, the valve train mechanism comprising:

a valve for opening or closing the intake port and the exhaust port formed in the cylinder head of the engine;

a cam mounted to the camshaft so as to be rotated together; and a rocker arm supported on a rocker shaft to be swingable, wherein:

the valve is opened or closed by swinging the rocker arm by rotation of the cam;

the rocker shaft is formed with an oil passage, inside the rocker shaft, extending in an axial direction and with an oil outlet communicating with the oil passage and extending in a radial direction of the rocker shaft;

the rocker arm includes a bearing portion supported on the rocker shaft, the bearing portion being formed with an oil injection hole for injecting lubricating oil from the oil outlet to a sliding contact portion side between the rocker arm and the cam;

the oil injection hole and the oil outlet are constructed at least so as not to be overlapped with each other at a time when the rocker arm is in sliding contact with a base circle portion of the cam and so as to be overlapped with each other at a time when the rocker arm is in sliding contact with a nose portion of the cam in a predetermined press-down state;

the rocker shaft is arranged, as viewed from an axial direction of the camshaft, on the upstream side in the rotational direction of the cam with respect to the sliding contact portion between the rocker arm and the cam; and the rocker arm is configured as a cantilever rocker arm that is pinched between the cam surface of the cam and an upper end of a valve stem of the valve, and thus, the lubrication oil is supplied at a time when the rocker arm is raised up by the cam.

2. The valve train mechanism of an internal combustion engine according to claim 1, wherein the oil injection hole of the rocker arm and the oil outlet of the rocker shaft are constructed so that an overlapped area becomes largest at a time when the rocker arm is mostly pressed downward by the nose portion of the cam.

3. The valve train mechanism of an internal combustion engine according to claim 1, wherein the oil injection hole of the rocker arm is directed so as to inject the lubricating oil to a cam surface on an upstream side in a rotational direction of the cam with respect to the sliding contact portion between the rocker arm and the cam.

4. The valve train mechanism of an internal combustion engine according to claim 1, wherein the oil injection hole of the rocker arm is formed substantially along a longitudinal direction of an arm of the rocker arm.

* * * * *